United States Patent [19]

Ludwig

[11] Patent Number: 4,907,659

[45] Date of Patent: Mar. 13, 1990

[54] POWERED SOIL-SAMPLER

[75] Inventor: Juergen Ludwig, Greenville, Miss.

[73] Assignee: BASF Corporation, Parsippany, N.J.

[21] Appl. No.: 145,294

[22] Filed: Jan. 19, 1988

[51] Int. Cl.[4] ..... E21B 10/02

[52] U.S. Cl. ..... 175/20; 175/246; 175/404

[58] Field of Search ..... 175/20, 58, 244, 246, 175/249, 323, 403, 404, 311, 162, 387; 73/863.43, 863.44, 863.45; 172/41, 25, 111; 11/4; 408/204, 206, 207

[56] References Cited

U.S. PATENT DOCUMENTS

| | | | |
|---|---|---|---|
| 2,062,257 | 11/1936 | Douglas et al. | 408/204 |
| 2,587,231 | 2/1952 | Schierding | 175/249 X |
| 3,047,081 | 7/1962 | Pitcher | 175/20 X |
| 3,709,534 | 1/1973 | Coe | 403/379 X |
| 4,535,853 | 8/1985 | Ippolito et al. | 175/404 |
| 4,586,857 | 5/1986 | Ohmi | 408/206 |
| 4,813,819 | 3/1989 | Hougen | 408/204 X |

FOREIGN PATENT DOCUMENTS

| | | | |
|---|---|---|---|
| 1255708 | 9/1986 | U.S.S.R. | 175/20 |

OTHER PUBLICATIONS

Southern State Co-operative; advertisement, No. Va.; Mar. 1986.

*Primary Examiner*—William P. Neuder

*Attorney, Agent, or Firm*—Rupert B. Hurley, Jr.

[57] ABSTRACT

An auger-type of device has a hollow central shaft for taking undisturbed soil samples. The tip of the device has teeth for grinding soil from around the sample. The device comprises a helical conveyor for transporting the ground product upwards and away from the soil sample.

16 Claims, 1 Drawing Sheet

POWERED SOIL-SAMPLER

BACKGROUND OF THE INVENTION

The present invention pertains to the field of boring or penetrating the earth, and more specifically to a boring apparatus having a receptacle therein for taking undisturbed sample of earth. The boring means has a helical conveyor for removing the soil around the sample.

The closest prior art of which applicant is aware is a soil sampler produced by Humax. Unlike the apparatus of the present invention, the Humax sampler does not have either a helical conveyor for removing soil from around the sample or teeth which have leading surfaces which are angled to force the ground soil radially outward.

BRIEF SUMMARY OF THE INVENTION

The apparatus of the present invention comprises an earth auger and a power means for rotating the earth auger. The auger comprises a hollow central shaft, a sample-receiving tube, a helical conveyor, and grinding teeth. The sample-receiving tube is positioned within the hollow centraL shaft. The helical conveyor extends radially outward from the outer surface of the hollow central shaft. In addition, the helical conveyor is secured firmly to the outer surface of the shaft. The grinding teeth are located on the lowermost end of the auger. The teeth are substantially vertical. The teeth have leading vertical surfaces which are angled outward so that the ground soil is forced radially outward whereby the helical conveyor transports the ground soil upwards and away from the undisturbed soil sample. A bottleneck is formed by a tapered surface within the hollow central shaft. The bottleneck is located a short distance above the grinding teeth. The minimum diameter of the bottleneck is smaller than the inside diameter of the sample-receiving tube.

The present invention enables the taking of undisturbed soil samples under a variety of conditions. For example, the apparatus will permit two men to take a soil sample two inches in diameter and two feet long from hard clay soil (e.g. a dried rice paddy) or in soil flooded with water (e.g. a flooded rice paddy). The apparatus does not necessarily require the use of electricity, as a gasoline engine can be used to power the device. The apparatus does not require the use of heavy equipment in order to take the soil sample (i.e. lifts and presses are not required). Rather, when the apparatus is fitted with handles, two men can supply whatever force is necessary for taking soil samples up to two inches in diameter and up to two feet deep.

BRIEF DESCRIPTION OF THE DRAWINGS

FIG. 3 is a view taken through line F3—F3 of FIG. 1.

DETAILED DESCRIPTION OF THE PREFERRED EMBODIMENTS

Figure 1:
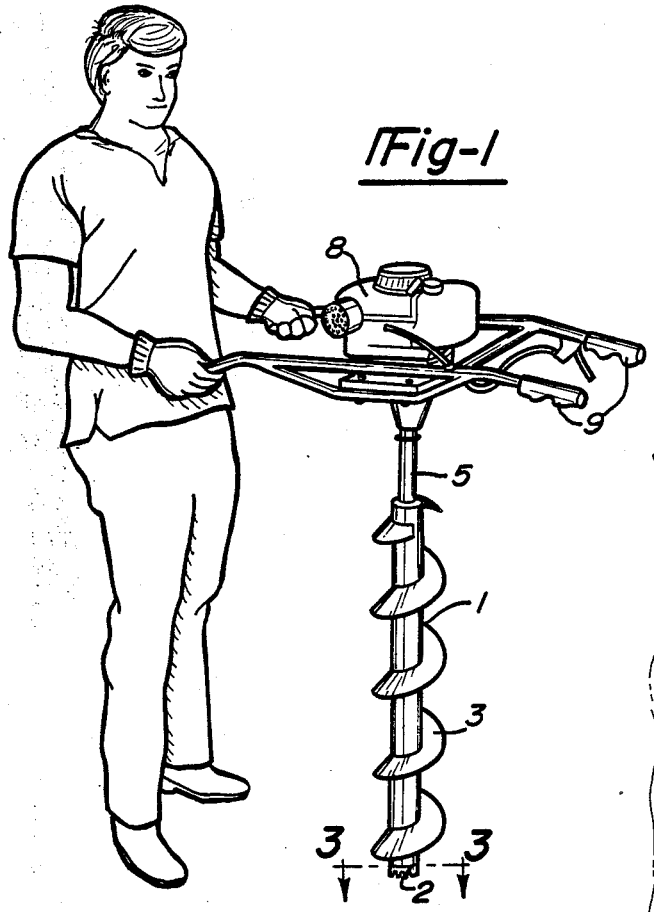
FIG. 1 is a perspective view of a preferred embodiment of the apparatus of the present invention.
Figure 2:
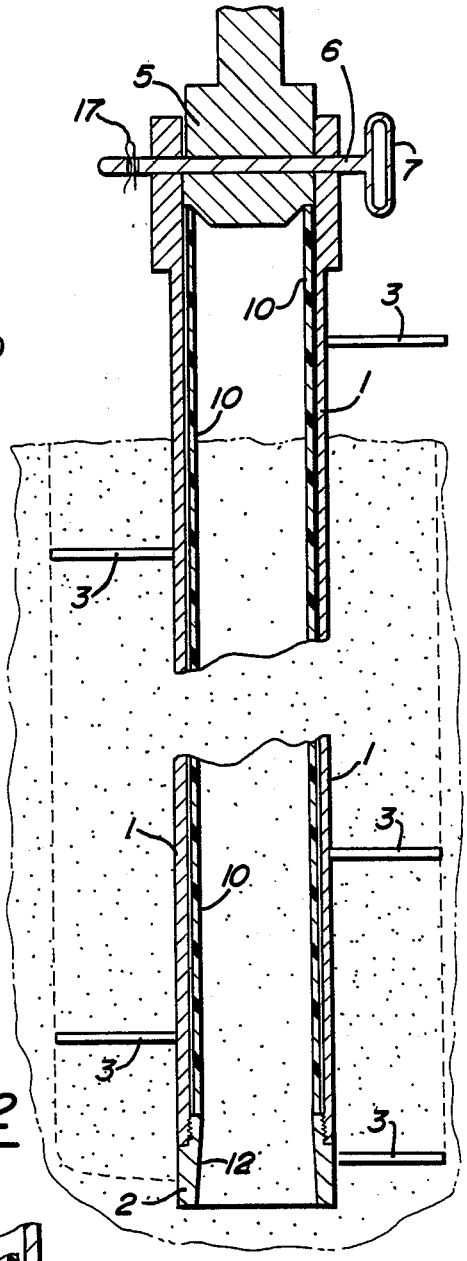
FIG. 2 is a longitudinal, cross-sectional view .

A most preferred embodiment of the apparatus is illustrated in FIGS. 1 through 4. The apparatus has a hollow central shaft (1) to which is continuously welded a helical conveyor (3). The hollow central shaft (1) terminates, on its lower end, in a tip (2) which has teeth (4) thereon. To the upper end of the central shaft (1), a drive shaft (5) is attached to the central shaft (1) with a pin (6). The pin (6) passes through both the drive shaft (5) and the central shaft (1). Preferably the pin (6), for ease of operation, is secured by a quick-release pull-type splint (17), as shown in FIG. 2. The apparatus is preferably powered by a gasoline engine (8). The apparatus preferably has two pairs of handles (9).

FIG. 2 illustrates in detail that portion of the apparatus which is below the drive shaft (5). As can be seen in FIG. 2, the sample-receiving tube (10) is positioned concentrically within the main shaft (1), between the tip (2) and the drive shaft (5). The tip (2) has an inner surface (12) which is flared. The ends of the sample-receiving tube (10) fit against both the tip (2) and the drive shaft (5). Most preferably the tip is not integral with the central shaft (i.e. is not one piece together with the central shaft) but rather screws onto the shaft as shown in FIG. 2.

Figure 3:
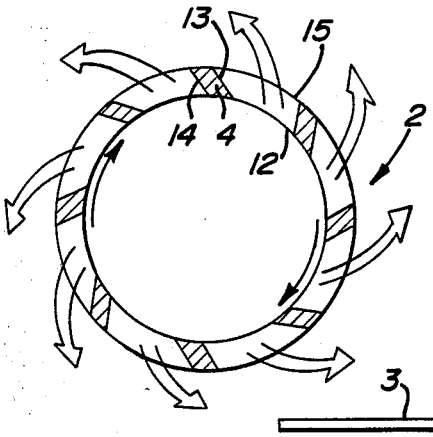
FIG. 3 is an enlarged, detailed cross-sectional view of the flared tip on the central shaft.

FIG. 3 illustrates an enlarged, cross-sectional view of the tip (2), as viewed from lines F3—F3 shown in FIG. 1. The teeth (4) have a leading vertical surface (13) which is angled so that when the tip rotates in the direction indicated in FIG. 3 (i.e. clockwise), the outwardly angled surfaces (13) will force ground soil radially outward and onto the helical conveyor (3). This prevents the ground soil from interfering with the collection of the undisturbed soil sample. Preferably the leading vertical surface is angled outwardly from 6 degrees to 10 degrees, and is more preferably angled outwardly at about 8 degrees. In FIG. 3, arrows indicate the outward radial direction of the ground product. The tip (2) has a "flared" inner surface (12). By "flared" it is meant that the inside diameter of the tip is slightly larger at its lower end than at its upper end. The inner surface (12) and the outer surface (15) of the tip (2) are not parallel to each other, but rather the inner surface (12) is preferably angled radially outward at an angle of between 1 degree and 5 degrees with respect to the longitudinal axis of the shaft (1) while the outer surface (15) is parallel to the longitudinal axis of the shaft (1).

Figure 4:
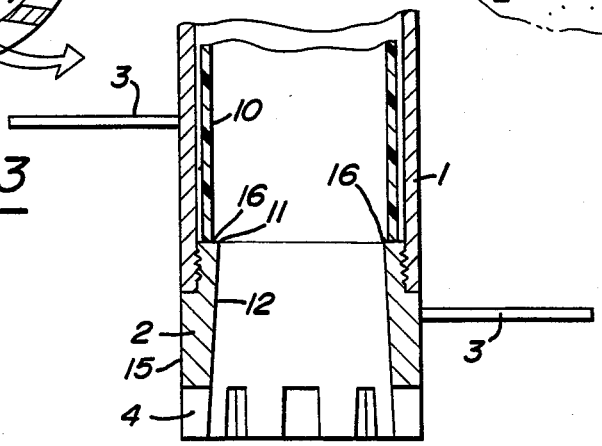
FIG. 4 is an enlarged longitudinal cross-sectional view of the lower end of the auger.

The "bottleneck" is most preferably formed at the upper end of the tip (2). The bottleneck is best illustrated in FIG. 4. Thus when the undisturbed soil sample is being taken, the sample initially passes upward and into the tip, during which time the sample is slightly compressed. The sample then enters the slightly larger diameter of the sample-receiving tube (10). When a desired depth of sample is obtained, the sample "breaks off" at the bottleneck when the auger is pulled upward from the soil.

In the most preferred apparatus as shown in FIGS. 1-3, the apparatus is powered by a gasoline engine of between 2 horsepower and 5 horsepower. Most preferably the engine has a horsepower rating of 3.5.

As stated above, the sample is slightly compressed when it passes through the conical tip (2). However, the sample-receiving tube (10) has an inside diameter which is larger than the smallest inside diameter of the bottleneck. The difference in the diameter of the bottleneck and the inside diameter of the sample tube is herein termed the "offset". In FIG. 4 the offset (16) is shown on each side. It is important that the offset is large enough that the sample is not subjected to so much shear force that the non-rotating sample disintegrates by coming into contact with the rotating sample tube (10). The offset preferably is between 0.03125 inch and 0.125 inch, and more preferably is between 0.0625 inch and 0.125 inch. Most preferably, the offset is approximately 0.0625 inch.

The soil sampler preferably rotates at a rate between 90 rpm and 200 rpm. Preferably the tip (2) has teeth (4) with leading surfaces (13) angled at 8 degrees from radial in order to force ground soil radially outward, (see FIG. 3). The tip (2) preferably has an axial length of aboout 2.5 inches, a maximum outside diameter of 2.75 inches and a minimum outside diameter of about 2.473 inches. The tip is preferably thicker at the top than at the bottom, due to the outwardly-angled inner surface. The thickness of the tip is governed by the thickness of the shaft (1) plus the thickness of the sample-receiving tube (10), plus the necessary clearances required, as well as the offset, discussed above. The teeth (4), on the lower end of the tip (2), preferably have a length of approximately 0.75 inch.

The sample collection tube (10) most preferably is a polyvinylchloride pipe (class 160, type SDR-26) having an outside diameter of approximately 2.375 inches and an inside diameter of 2.193 inches. The wall thickness of this pipe can vary as much as 0.016 inch.

In order to remove the sample, the pin (6) is removed, after which the auger is inverted and the sample tube (10) and sample come out together.

The helical conveyor preferably has a width of approximately 2 inches. The helix angle (i.e.) the angle the helix makes with respect to the axis of the central shaft (1) is preferably approximately 35 degrees. The helical conveyor preferably extends down almost to the teeth, so that the soil which is loosened by the teeth is quickly transported upward. It is most preferred that the lowermost 2.5 inches of the helical conveyor is not secured to the main shaft but rather is left unsecured and is flexible enough to be bent into a desired configuration.

In general, the apparatus may be used to take undisturbed soil samples having any desired diameter, but the apparatus is generally used to take sample having a diameter of from 0.75 to 6.0 inches. Preferably the sample diameter is from 1 to 3 inches and most preferably the sample diameter is approximately 2 inches. The apparatus may be designed to take a sample to any desired depth, but preferably the sample depth is from 1 foot to 4 feet.

The embodiments of the invention in which an exclusive privilege or property is claimed are defined as follows:

1. A powered apparatus for taking an undisturbed soil sample comprising:

A. an earth auger comprising:

1. a hollow central shaft within which is a removable sample-receiving tube;
2. a helical conveyor, the conveyer extending radially outward from, and secured firmly to, the outer surface of the hollow central shaft;
3. grinding teeth located on the lowermost end of the auger, the teeth being substantially vertical when the apparatus is in an upright position, the teeth having leading vertical surfaces which are angled radially outward with respect to the rotational direction, so that the ground soil is forced radially outward whereby the ground soil is prevented from interfering with the collection of the undisturbed soil sample;
4. a bottleneck formed by a tapered surface within the hollow central shaft, the bottleneck being located shortly above the grinding teeth, the minimum diameter of the bottleneck being smaller than the inside diameter of the sample-receiving tube; and B. a power means for rotating the auger.

2. The apparatus as described in claim 1 wherein the power means is a gasoline engine mounted above the auger.

3. The apparatus as described in claim 1 wherein the apparatus is a hand-held device having handles thereon.

4. The apparatus as described in claim 1 wherein the grinding teeth and bottleneck are on a grinding tip which is fastened to the lowermost end of the central shaft.

5. The apparatus as described in claim 1 wherein the soil sample can be removed from the central shaft by inverting the auger after detaching the power means from the auger.

6. The apparatus as described in claim 1 wherein the apparatus takes an undisturbed soil sample having a diameter between 0.75 inch and 6 inches.

7. An apparatus as described in claim 1 wherein the apparatus takes an undisturbed soil sample between 1 inch and 3 inches in diameter and wherein the width of the conveyor is approximately 2 inches.

8. An apparatus as described in claim 1 wherein the apparatus is designed to take a sample between 1 foot and 4 feet in length.

9. An apparatus as described in claim 1 wherein the leading vertical surfaces of each of the teeth are angled outwardly at between 6 degrees and 10 degrees to their respective radii.

10. An apparatus as described in claim 1 wherein the tapered surface forming the bottleneck has a length of approximately 2.5 inches and wherein the taper angle is approximately 3 degrees.

11. An apparatus as described in claim 1 wherein the helical conveyor has a helix angle of approximately 35 degrees.

12. An apparatus as described in claim 1 wherein the offset has a size between 0.0625 inch and 0.125 inch.

13. An apparatus as described in claim 2 wherein the device has handles, the width of the helical conveyor is approximately 2 inches, the tapered surface forming the bottleneck has a length of approximately 2.5 inches and a taper angle of approximately 3 degrees.

14. An apparatus as described in claim 13 wherein the leading vertical surfaces of each of the teeth are angled outwardly at approximately 8 degrees.

15. An apparatus as described in claim 13 wherein the offset is approximately 0.0625 inch.

16. An apparatus as described in claim 15 wherein the leading vertical surfaces of the teeth are angled outwardly at approximately 8 degrees.

* * * * *